United States Patent [19]

Wingen

[11] Patent Number: 4,561,335

[45] Date of Patent: Dec. 31, 1985

[54] SLITTING MECHANISM HAVING A REMOVABLE BLADE

[75] Inventor: Peter P. Wingen, Overath, Fed. Rep. of Germany

[73] Assignee: Dienes Werke für Maschinenteille, GmbH & Co. KG, Overath, Fed. Rep. of Germany

[21] Appl. No.: 534,373

[22] Filed: Sep. 21, 1983

[51] Int. Cl.[4] ..... B26D 1/22

[52] U.S. Cl. ..... 83/481; 83/506; 83/508.1; 83/563

[58] Field of Search ..... 83/481, 506, 508.1, 83/563, 676

[56] References Cited

U.S. PATENT DOCUMENTS 2,997,906 8/1961 Burk et al. ..... 83/506
3,564,962 2/1971 Wingen .
3,777,607 12/1973 Schofield ..... 83/506
3,921,488 11/1975 Mastriani .
3,977,284 8/1976 Mastriani et al. .
4,161,898 7/1979 Wingen ..... 83/171

FOREIGN PATENT DOCUMENTS 2074492 11/1981 United Kingdom ..... 83/506

*Primary Examiner*—Donald R. Schran
*Attorney, Agent, or Firm*—Blodgett & Blodgett

[57] ABSTRACT

Cutting mechanism for cutting sheet material comprising a disc blade which is adapted to engage a pressure roller and which is mounted for rotation in a carrier which is slidably mounted within vertical guide grooves which are formed on the inner surfaces of a pair of guide plates. Each guide plate has a horizontal bottom edge, a vertical side edge, a sloped edge and an inclined groove which extends from the vertical guide groove to an opening at the sloped edge of the plate. The plates are connected at several locations and stiffering means are provided near the intersection of the side and sloped edges.

4 Claims, 2 Drawing Figures

SLITTING MECHANISM HAVING A REMOVABLE BLADE

BACKGROUND OF THE INVENTION

The invention relates to a hydraulic or pneumatic actuated holder along a holder beam for a rotating pressure blade cooperating with a hardened counter pressure roller. The invention is used for longitudinal separation of bands, especially from heavy materials, in a roll cutting machine, whereby the piston of a pressure housing is directly connected with a fork-shaped carrier of the pressure blade. The pressure housing has the shape of a flat can and is arranged in such a way that it is positioned with its narrow side parallel to the pressure blade axis and fastened flush on the open top side of a flat, nearly rectangular-shaped guide piece for the cutter carrier. The guide piece consists of two plates bolted against spacers.

A blade holder such as that which is described above is shown in British Pat. No. 14 70 357. It has the advantage of a small axial dimension, which determines the smallest possible width of the material strip to be cut between the neighboring cutter carriers.

Since nearly the whole cross-section of the narrow side of the rectangular shaped guide piece is utilized as a cylinder for a working piston, the known cutter carrier may exert considerable start-up force to the cutter in spite of its advantageous flat design. This force is necessary because the material is not cut by the blade but squeezed apart on a glass-hard counter pressure roller. Against this squeeze force, the blade is supported with its hub over a large area partially on the inside of the plates of the guide piece, and partially on the flush inside of the arms of the flat fork-shaped blade carrier and where the blade carrier also is supported within flat-vertical guide grooves of the plates in the axial direction. In spite of the advantageous flat design of the known blade carrier, the pressure blade can be pressed with strong force onto the glass-hard surface of the counter pressure roller and supported against tilt, so that the cutting edge of the blade may not be displaced axially on the counter roller. Such displacements would damage the machine and the material to be cut as it runs through. The pressure blade can be easily pulled out of the blade holder when it is in the lifted state relative to the counter pressure roller, and may be exchanged without dismantelling for the purpose of repair. In the known blade holders, the corners of the two plates, which are positioned opposite each other diagonal to the upper holder beam, have step-like cut-outs. The plates form a pair of flat guide grooves, positioned opposite each other for the flat-shaped fork-like cutter carrier from which extend branches into the sloped areas. The ends of the flat fork-shaped carrier of the squeeze blade form cut-outs against the open slide-in slots for the axle bolt of the pressure blade similar to that shown in U.S. Pat. No. 3,777,607.

The step-like cut-outs of the above described plate corners make it possible for the free positioned pressure blade to be pulled out forwardly and downwardly after it has been raised from the counter pressure roller. This also makes it possible to position in the open step area a felt strip and lubricator in the roller cut machine for the maintenance of the edges of the pressure blades.

However, these advantages on the known pressure blade holder have brought about some disadvantages, namely, that the mentioned step-shaped cut-outs within the plates reduce considerably the stiffness of the formed frame-shaped guide piece for the pressure blade and the fork-shaped pressure blade carrier. The result is an unclean squeeze cut in the material, especially when a tough or thick material has to be separated lengthwise into strips such as wrapping strips.

This invention suggests keeping the advantages of the known pressure blade holder, but to increase the stability of the parallel guide for the pressure blade in such a way that the step-shaped cut-outs, within the two plates are not used. Instead, slopes are formed whereby the plates on the upper ends of their slopes are stiffened by an additional bolting. This additional bolting is positioned with regard to the axle bolt of the extended pressure blade to the bolting on the lower holder beam connection nearly opposite.

BRIEF DESCRIPTION OF THE DRAWINGS

The invention is described in view of a schematically shown design example in which.

DESCRIPTION OF THE PREFERRED EMBODIMENT

Figure 1:
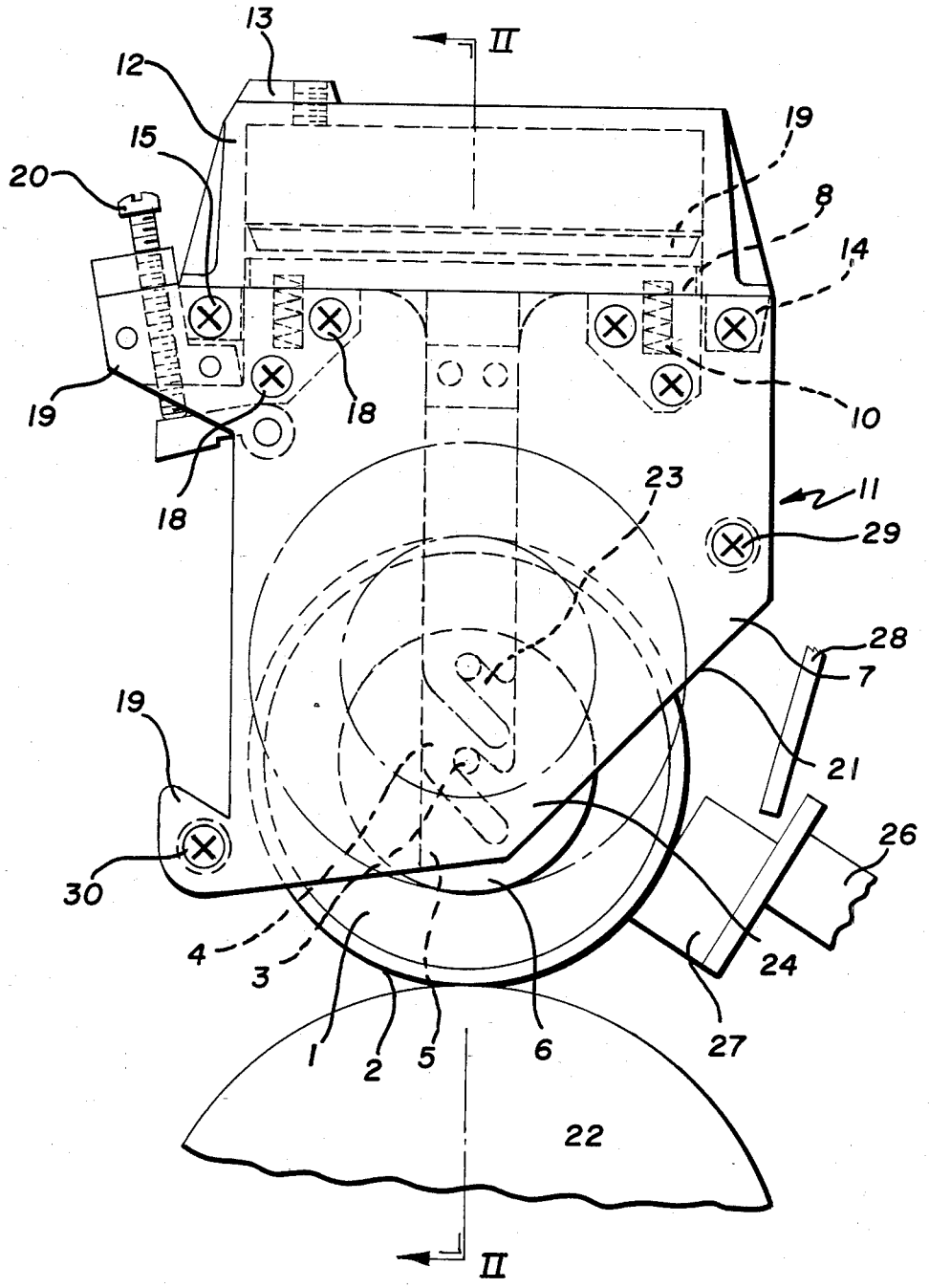
FIG. 1 is a side elevational view.
Figure 2:
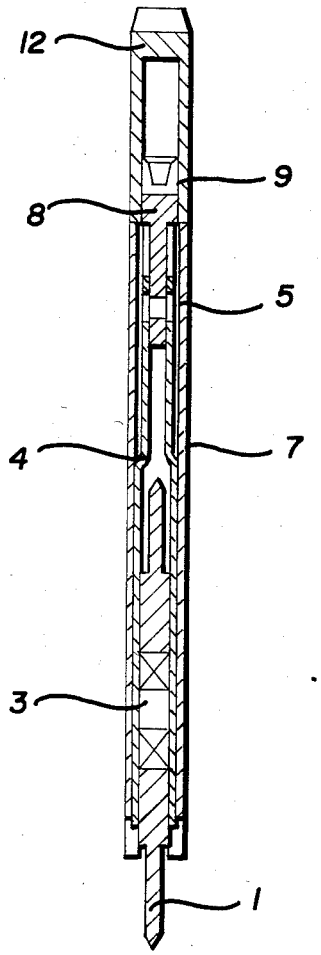
FIG. 2 is a vertical sectional view taken along the line II—II of FIG. 1.

A pressure blade having a sharpened cutting edge 2 is tightly supported on the ends by arms of a flat fork 4 which constitutes a blade carrier. The fork arms are guided within shallow vertical grooves 5 in plates 7 which are located outside of the reinforced portion 6 of the pressure blade 1 from both sides and without any play. The pressure blade 1 with its fork 4 may move axially in relation to a flat can-shaped pressure housing 12, together with piston 8 which is positioned above the fork and under the action of pressure above a sealing ring 9 in start-up position and urged to the upper rest position under counter-pressure of helical springs arranged within blind holes 10.

The outer side wall of the pressure housing 12 terminates flush with the two plates 7 of the guide frame 11 for the fork-shaped blade carrier 4 and its inside space is of substantially oval shape. A supply aperture 13 for the pressure medium is located within the cover and may be constructed in the form of an internal screw thread within a collar-shaped reinforcement into which is screwed a corresponding supply tube.

The piston sealing ring 9 is designed correspondingly thin since it is supported over the whole area by the piston 8 of the blade carrier 4. The pressure housing 12 through its extensions 14 engages the two plates 7 of the guide piece 11 and lies between them, and is detachably connected to the plates by common bolts 15.

At the left side of the guide frame 11 which is formed by the 2 plates 7 and spacers, there is formed a holding device 19 with an arresting screw 20. A plurality of pressure blade holders are located in known manner (not shown) on a holder beam of dovetail shape and are arranged parallel to the beam and the pressure blade axis, and are displacable for selecting the cut width in relation to a smooth glass-hard steel counter pressure roller 22 for conveying the cutting material (not shown) is positioned parallel opposite the pressure blade and the widths are selectable down to the small dimension of a single pressure blade holder.

According to this invention the diagonal corners of both plates 7 which are opposite the upper holder beam connection 19, are formed with slopes 21, in which the pressure blade 1 is gripped and, in its position of rest in which the blade is raised from the counter pressure roller 22 is pulled out forward without the pressure blade holder swinging away from the holder beam or being dismantled.

The pulled-out support for the pressure blade consists of push-in slots 23 for the axle bolt 3 of pressure blade 1 which are open in the area facing the slopes 21 and in the lifted position of the pressure blade, shown in dash lines, the branches 24 of guide grooves 5 within plates 7 are aligned with and extend toward the slopes 21.

On the upper end of the slopes 21, the plates 7 are connected with each other over an inserted spacer and an additional bolt connection 29. The bolt connection is positioned, in regards to the lower bolt connection 30, on the holder beam connection 19, nearly opposite to the extended position of the pressure blade 1, whereby a special effective stiffening is achieved for the parallel guide of pressure blade 1 on its hub 6.

A continuous hard felt strip 27 is arranged on a support bar 26 which is mounted to the machine frame and extends over the whole effective width of the pressure blade. The felt strip is supplied with a lubricant through a tube 28 and while in operating condition of the pressure blades 1 lowered by the pressure roller 22, (outlined in FIG. 1) can touch the cutting edge 2.

I claim:

1. Cutting mechanism which is arranged to be mounted alongside other identical cutting mechanisms on a horizontal support bar for the longitudinal cutting of sheet material which is passed between the cutting mechanism and a counterpressure roller, the cutting mechanism comprising:

(a) a guide frame which is formed by two flat vertical plates having opposed and spaced inner flat surfaces, one side of said guide frame being mounted on said support bar so that the plates extend substantially perpendicularly from the bar, each of said plates having a generally horizontal bottom edge, a substantially vertical side edge and a sloped edge, said bottom edge being spaced from and facing said counterpressure roller, and extending from said one side to a first point which is between said one side and the opposite side of said frame, said vertical side edge being located at said opposite side of the frame and terminating at a second point which is substantially higher than said bottom edge, said sloped edge extending from said first point to said second point, said bottom edges defining a bottom opening in said guide frame, said sloped edges defining a sloped opening in said frame, said inner flat surfaces having opposed vertical grooves which extend to said bottom edge and opposed inclined grooves which extend from the lower end of said vertical grooves to said sloped opening, (b) a fluid pressure actuator including a housing which is mounted on top of said guide frame and a piston which is mounted for vertical movement within said housing, (c) a carrier which is connected at its upper end to said piston and which includes a pair of spaced arms which are slidably mounted in said opposed vertical grooves, the lower end of each arm having an inclined slot which has an opening that faces said sloped edge, (d) a disc blade which is positioned between said flat plates and including an axle which is located in said inclined slots to enable the disc blade to rotate about an axis which is perpendicular to the flat plates and to enable the disc blade to be moved vertically upon vertical movement of the carrier by said piston between a lower position in which the disc blade projects below the bottom edges of said plates and bears against said counterpressure roller and an upper position in which the bottom of the disc blade is substantially spaced from the roller, said axle being slidably mounted in said inclined slots so that the disc blade can be removed from the frame through said bottom opening and said sloped opening when the disc blade is in the upper position, and (e) stiffening means for connecting said flat plates at a third point which is adjacent said second point, said third point being located below the top of the disc blade when the disc blade is in its upper position and spaced from the counterpressure roller a distance which is greater than the diameter of the disc blade.

2. Cutting mechanism as recited in claim 1, wherein the longitudinal axis of said vertical grooves is substantially perpendicular to said sloped edges.

3. Cutting mechanism as recited in claim 1, wherein a second stiffening means for connecting said flat plates is located at a fourth point, said fourth point being at the lower portion of said one side of the guide frame so that said fourth point is substantially diametrically opposed to said third point relative to the axel of said disc blade.

4. Cutting mechanism as recited in claim 1, wherein said second point is located below the top of the disc blade when the disc blade is in its lower position and the stiffening means is located at substantially the same level as the top of the disc blade.

* * * * *